US005961117A

United States Patent [19]

Scarselli

[11] Patent Number: 5,961,117

[45] Date of Patent: Oct. 5, 1999

[54] DIE FOR USE WITH A CROUPIER TYPE GAMING TABLE

[75] Inventor: Antonio Scarselli, College Point, N.Y.

[73] Assignee: Hand Rolle Inc., Beechhurst, N.Y.

[21] Appl. No.: 09/085,577

[22] Filed: May 28, 1998

Related U.S. Application Data

[63] Continuation of application No. 08/130,743, Oct. 4, 1993, abandoned.

[51] Int. Cl.[6] ..... A63F 9/04

[52] U.S. Cl. ..... 273/146; 273/274

[58] Field of Search ..... 273/146, 143 A, 273/274, 309

[56] References Cited

U.S. PATENT DOCUMENTS

| | | | |
|---|---|---|---|
| 1,054,341 | 2/1913 | Cowles | 273/146 |
| 1,525,023 | 2/1925 | Brown | 273/146 |
| 1,986,710 | 1/1935 | Brown | 273/146 |
| 4,299,392 | 11/1981 | Tammen | 273/274 |
| 4,346,900 | 8/1982 | Lamlee | 273/146 |
| 4,436,306 | 3/1984 | Sanders | 273/146 |
| 4,524,975 | 6/1985 | Caughie et al. | 273/146 |
| 4,566,697 | 1/1986 | Vickers | 273/146 |
| 4,682,778 | 7/1987 | Willis et al. | 273/146 |
| 4,717,154 | 1/1988 | Miller | 273/146 |
| 4,887,819 | 12/1989 | Walker | 273/256 |
| 4,943,062 | 7/1990 | Gillette | 273/146 |
| 4,989,874 | 2/1991 | Freitas | 273/146 |
| 4,989,875 | 2/1991 | Capy | 273/146 |
| 5,224,708 | 7/1993 | Gathman et al. | 273/146 |
| 5,261,666 | 11/1993 | Chen et al. | 273/146 |

FOREIGN PATENT DOCUMENTS

| | | | |
|---|---|---|---|
| 2202159 | 9/1988 | United Kingdom | 273/146 |

OTHER PUBLICATIONS

DE3152–034–A, German Patent, to Ennst, Jul. 1983 273–146.

EP–277–658–A, European Patent, to Heinz, Aug. 1988 273–146.

*Primary Examiner*—Benjamin H. Layno

*Attorney, Agent, or Firm*—Richard L Miller, P.E.

[57] ABSTRACT

A die for use with a croupier type gaming table for which there are many games which are devised and played appropriately with the die. The die includes a core and a skin disposed on the core. The core has a shape that is a regular octahedron with eight faces that are congruent equilateral triangles which intersect each other at their edges which intersect each other at their vertices. The skin includes eight equilateral triangular pyramids, each of which has a base that is triangular, three lateral faces that are triangular and meet in a common vertex and intersect each other at three lateral edges. The base of each pyramid of the skin is disposed on, and is congruent with, a respective face of the core, with a respective pyramid extending outwardly therefrom. A lateral face of a pyramid of the skin and a lateral face of an adjacent pyramid of the skin, which share a common edge of a respective face of the core, together define a set, with the skin having a total of twelve sets thereon. Two opposing sets of the twelve sets are colored white, five opposing sets are colored red, and five opposing sets are colored black. Each set of the skin is divided into four congruent triangles that are consecutively numbered, with each set alternating between different odd and even numbers, and with the numbers ranging from 1 to 43.

5 Claims, 3 Drawing Sheets

DIE FOR USE WITH A CROUPIER TYPE GAMING TABLE

CROSS REFERENCE TO RELATED APPLICATIONS

The instant application is a continuation of application Ser. No. 08/130,743, filed on Oct. 4, 1993, and now abandoned.

BACKGROUND OF THE INVENTION

1. Field of the Invention

The present invention relates to a die. More particularly, the present invention relates to a die for use with a croupier type gaming table.

2. Description of the Prior Art

Numerous innovations for game related devises have been provided in the prior art that will be described. Even though these innovations may be suitable for the specific individual purposes to which they address, however, they differ from the present invention.

FOR EXAMPLE, U.S. Pat. No. 4,299,392 to Tammen teaches a game of chance that includes a game board with a plurality of sections thereon. The sections are labeled with various indicia, or combinations thereof, and odds pertaining thereto. A chance indicator device for simultaneously selecting one such indicia and a game command. The device includes two sections rotatably joined together, wherein one section is friction fit about a shaft so that it cannot rotate relative thereto, and the other section is rotatably mounted to the shaft. Both sections are identically shaped so that they may be interchangeably mounted on the shaft either by themselves or in combination, one section containing indicia on its faces and the other section containing game commands on its faces. The device is spun on the game board so as to select the indicia and/or game commands.

ANOTHER EXAMPLE, U.S. Pat. No. 4,346,900 to Lamlee teaches a game which may be played by two or more persons includes a playing board and a pair of dice. The board comprises three concentric play areas, the outer two of which are divided into arcuate sections. The central play area designates a type of dice which is to be used with the particular game board. The various play areas are provided with indicia to indicate an appropriate payoff rate to be associated with that area. A number of variations of the game board are possible, each of which is to be played with particular shaped dice.

STILL ANOTHER EXAMPLE, U.S. Pat. No. 4,436,306 to Sanders teaches a set of five game dice, which enables a player to obtain scoring combinations, in a variant of the game of Yacht, which correspond to flushes and straight flushes in the card game of poker. Each die is eight-sided, and carries a unique combination of numerical attribute markings and suit attribute markings, selected from a range of eight numerical values and five suits.

YET ANOTHER EXAMPLE, U.S. Pat. No. 4,524,975 to Caughie et al. teaches a football type game board utilizing specially designed, dice-like casting solids to represent the various plays used in the game of football. Each solid has a plurality of sides with markings denoting a particular outcome to that play. The number of sides and their markings are chosen to reflect real football game statistics. Also provided is a penalty card system organized into four categories, to produce a realistic penalty for particular types of plays, and a first down marker system with a down indicator sleeve.

STILL YET ANOTHER EXAMPLE, U.S. Pat. No. 4,566,697 to Vickers teaches a game apparatus "Ambush the Double Dealing Western Game of Skill and Risk." The game has a game board having a continuous path around its perimeter divided into consecutive spaces, having alternate paths, and bearing instructions representing amounts to be paid or received during the game. Each of the spaces define a playing position. There is also provided a plurality of playing pieces one for each player in the forms of a bullet, a stagecoach, a saddle and a wagon. Also provided is play money of different denominations for partial distribution to each player, and playing cards bearing instructions. A novel chance determining device is provided to represent the number of playing positions to be moved by the playing pieces and a card area encased by vertical walls for storing the used and unused playing cards.

YET STILL ANOTHER EXAMPLE, U.S. Pat. No. 4,682,778 to Willis et al. teaches a game that has a board showing a voting area marked House of Representatives, a voting area marked Senate, a vice-president's voting booth located inside the Senate, and a president's voting booth located between and separate from the House of Representatives and the Senate. Inside both the House of Representatives and the Senate voting areas are eight industry voting booths where players (representing industries) try to accumulate more and more voting chips. An area numbered 2 thru 12 on the game board specifies what is done when each player's turn comes and two regular dice are rolled as a means of chance. Election cards allow players to win voting chips in the House of Representatives, the Senate, the vice-presidency, and the presidency. Politics cards give players a variety of political advantages. Legislation cards target different game industries (players) for potential financial gains or losses, dependent upon votes taken in Congress. A changeable colored die determines which players win election votes and which industries (players) are targeted for financial gains or losses. Players begin the game with a designated sum of game money and try to remain financially solvent. Bankrupt players are eliminated from the game.

STILL YET ANOTHER EXAMPLE, U.S. Pat. No. 4,717,154 to Miller teaches a new and useful game apparatus for combining chance play with mathematical operation. The apparatus comprises a game board having a playing surface laid out with a sequence of numbered playing spaces, a set of markers for use in marking positions within the sequence of playing spaces, and at least two dice each marked on the sides thereof with a series of numbers. The numbers in the group of series on the dice form a number set. Each series in the number set is chosen such that the first number in the first series is zero or one. If the first number in the first series is zero, then one number in each other series may be zero and otherwise no two numbers are the same within the set and each number in each series subsequent to the first series is larger than any number in any preceding series. If the first number in the first series is one, then one number in each other series may be zero, one number of the second series may be the same as the highest number of the first series, and otherwise no two numbers are the same within the set and each number in each series subsequent to the first series is larger than any number in any preceding series.

YET STILL ANOTHER EXAMPLE, U.S. Pat. No. 4,887,819 to Walker teaches a board game incorporating various gambling methods. A player uses either a card game similar to blackjack or a slot machine to determine the number of spaces to be moved along a segmented path, the particular game being selected by the instructions contained in the segment on which the player landed on the prior move. Each segment also contains further instructions, some of those instructions designating a further gambling apparatus and giving odds. These further apparatuses are a roulette fame or a dice game, and the player landing on that segment may gamble at these games at the designated odds. Other players can join in the gambling when the roulette game and the dice game are played. The objective of the game is for a player to avoid penalties designated on the game board, acquire a majority of the playing chips until either all of the other players become "busted" or the casino bank becomes "busted".

STILL YET ANOTHER EXAMPLE, U.S. Pat. No. 4,943,062 to Gillette teaches a housing that contains a plurality of tetrahedron shaped dice. The faces of the dice bear one or more indicia. The housing includes a tumbling compartment in which all of the dice are shaken and a smaller plurality of pyramidal shaped cavities in which certain of the dice are then disposed for viewing. At least a portion of one face of each die is visible through the wall of the housing in one embodiment, while at least a portion of two faces of each die is visible in another embodiment.

YET STILL ANOTHER EXAMPLE, U.S. Pat. No. 4,989,874 to Freitas teaches a set of lottery game dice to aid in selecting six numbers between "one" and "forty-nine" to "fifty-three" that are regular decahedron shaped. The total of the numbers displayed on the six dice are obtained by using some dice having eight surfaces displaying numbers and some displaying nine numbers. The dice are formed by providing one or two of the ten surfaces with an extending convex numbered surface to prevent the die from settling on that surface, thus eliminating one or two available surfaces for display.

STILL YET ANOTHER EXAMPLE, U.S. Pat. No. 4,989,875 to Capy et al. teaches die containing eight planar hexagonal surfaces and six convex portions capable of producing random results when thrown. The convex faces are dimensioned so as to constitute areas of unstable equilibrium to favor positioning of the die on one of the hexagonal surfaces when so thrown. The die can be marked with card values and suits associated with a deck of playing cards whereby a set containing the marked dice can be utilized to play poker card games. Moreover, the card values and suits can be positioned on the dice so that marking of the dice can be performed in a two pass printing process.

YET STILL ANOTHER EXAMPLE, U.S. Pat. No. 5,224,708 to Gathman et al. teaches 12-sided and 20-sided dice which have a suit symbol and a value symbol on each surface representing one of the various playing cards in a standard 52 card playing deck. The 12-sided die will carry 3 different value symbols for each of the 4 suits and, accordingly, will depict 12 different cards, one on each of its surfaces which are identically shaped pentagons. A game is disclosed which employ three or more of such dice, all identical. In another embodiment a 20-sided die is provided which carries 5 values of each of the four suits. In all embodiments, parallel, opposing surfaces will bear the same value symbol and no two surfaces adjoined together along a common edge will bear the same suit symbol. This symmetrical arrangement provides for integrity of chance in re-rolling the dice and complete randomness of chance.

STILL YET ANOTHER EXAMPLE, U.S. Pat. No. 5,261,666 to Chen et al. teaches a game device comprising mainly a geometric body having at least two flat external faces, each of the flat external faces is provided with at least one indicating piece, each of the indicating piece is provided with at least one indicating face, each of the indicating faces is provided with at least one indicium.

YET STILL ANOTHER EXAMPLE, German Patent No. DE3152-034-A to Ernst teaches a teaching aid used to pose random questions, particularly, but not exclusively during musical instruction, e.g. to identify notes or intervals or chords of a tone scale and point them out on a keyboard, or note values, key signatures, tempi, other symbols etc. It consists of a multi-faceted regular solid with parallel opposite faces, such as an octahedron, or a dodecahedron with pentagonal faces, the symbols being shown on the respective faces. The solid is thrown as a die after which the uppermost symbol is to be identified.

STILL YET ANOTHER EXAMPLE, European Patent No. EP-277-658-A to Heinz teaches a die having more than six faces. It is pre-formed from a basic sphere with four flat faces formed on each hemisphere giving a total of eight faces, with each face bearing is different number or symbol. Alternatively, the die may be in the form of an octahedron, with each face forming an isosceles triangle. A third Possibility is a pentagonal dodecahedron with a circular depression in one of the faces.

FINALLY, YET STILL ANOTHER EXAMPLE, Great Britain Patent No. 2,202,159,A to Houlgate teaches an octahedron for use in playing a game that comprises a cut and scored rigid sheet which may be erected to form an octahedron having triangular plan facets. A line of separation is provided extending between two opposed corners whereby force applied between said corners causes the octahedron to collapse to a flat form. An elastic member is provided internally connecting opposed parts each side of the line of separation, said elastic member acting to tend to erect the octahedron.

It is apparent that numerous innovations for game related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a die for use with a croupier type gaming table that avoids the disadvantages of the prior art.

ANOTHER OBJECT of the present invention is to provide a die for use with a croupier type gaming table that is simple and inexpensive to manufacture.

STILL ANOTHER OBJECT of the present invention is to provide a die for use with a croupier type gaming table that is simple to use.

BRIEFLY STATED, YET ANOTHER OBJECT of the present invention is to provide a die for use with a croupier type gaming table for which there are many games which are devised and played appropriately with the die. The die includes a core and a skin disposed on the core. The core has a shape that is a regular octahedron with eight faces that are congruent equilateral triangles which intersect each other at their edges which intersect each other at their vertices. The skin includes eight equilateral triangular pyramids, each of which has a base that is an equilateral triangle, three lateral faces that are right triangles and meet in a common vertex and intersect each other at three lateral edges. The base of each pyramid of the skin is disposed on, and is congruent with, a respective face of the core, with a respective pyramid extending outwardly therefrom. A lateral face of a pyramid of the skin and a lateral face of an adjacent pyramid of the skin, which share a common edge of a respective face of the core, together define a set, with the skin having a total of twelve sets thereon. Two opposing sets of the twelve sets are colored white, five opposing sets are colored red, and five opposing sets are colored black. Each set of the skin is divided into four congruent triangles that are consecutively numbered, with each set alternating between different odd and even numbers, and with the numbers ranging from 1 to 48.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

| | |
|---|---|
| 10 | die for use with a croupier type gaming table of the present invention |
| 12 | croupier type gaming table |
| 14 | core |
| 16 | skin |
| 18 | eiqht faces of core 14 |
| 20 | edges of eight faces 18 of core 14 |
| 22 | vertices of eight faces 18 of core 14 |
| 24 | eight equilateral triangular pyramids of skin 16 |
| 26 | base of each pyramid of eight equilateral triangular pyramids of skin 16 |
| 28 | three lateral faces of each pyramid of eight equilateral triangular pyramids of skin 16 |
| 30 | common vertex of three lateral faces 28 of each pyramid of eight equilateral triangular pyramids of skin 16 |
| 32 | three lateral edges of each face of three lateral faces 28 of each pyramid of eight equilateral triangular pyramids of skin 16 |
| 34 | pattern |

DETAILED DESCRIPTION OF THE PREFERRED EMBODIMENT

Figure 1:
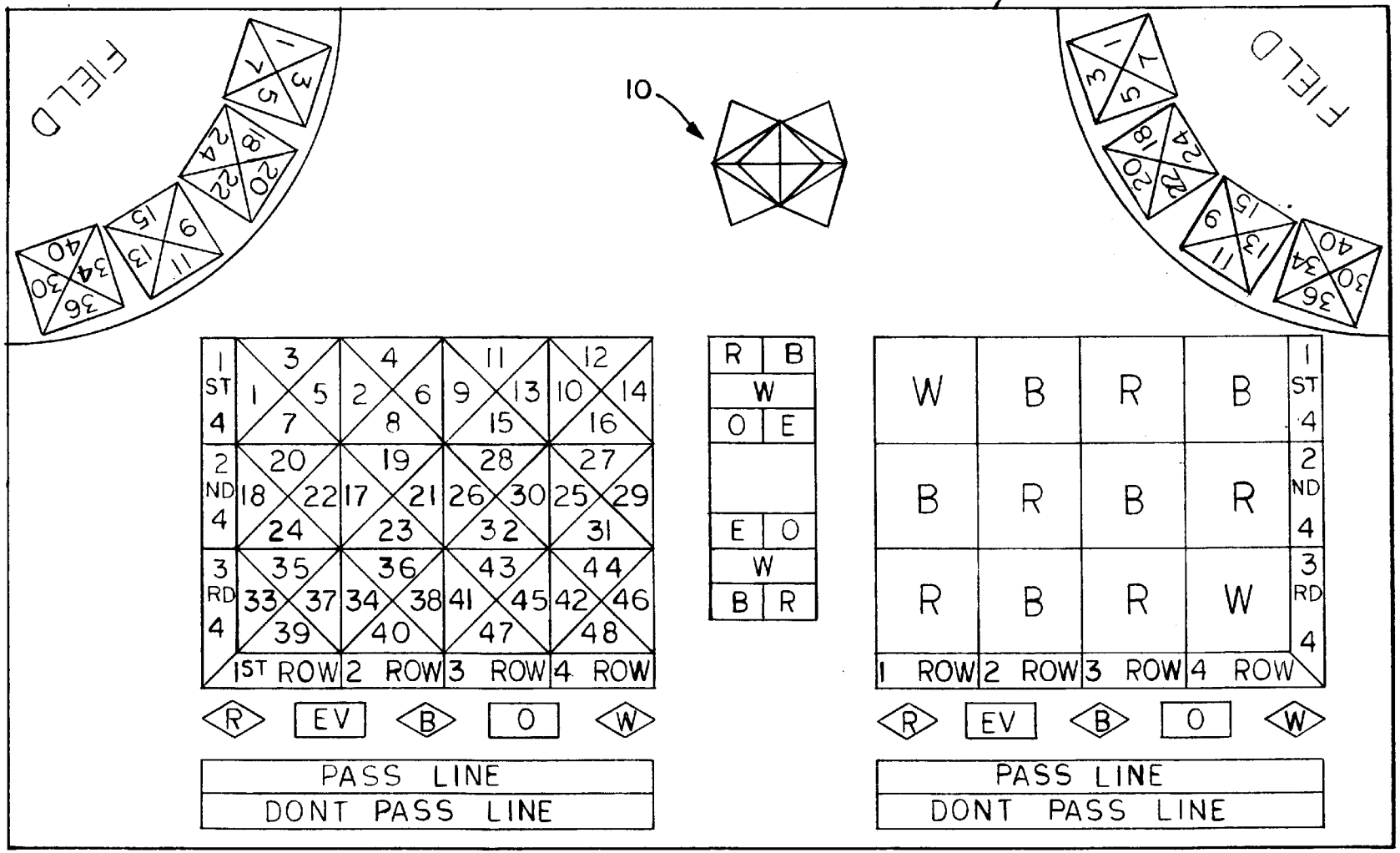
FIG. 1 is a diagrammatic top plan view of the present invention for use with a typical croupier type gaming table.

Referring now to the figures, in which like numerals indicate like parts, and particularly to FIG. 1, the die for use with a croupier type gaming table of the present invention is shown generally at 10 for use with a croupier type gaming table 12 for which there are many games which are devised and played appropriately with the die for use with a croupier type gaming a table 10.

At this point, for the Examiner's convenience, applicant would like to present a discussion on polyhedrons, the shapes particularly the regular octahedron and the equilateral triangular pyramid, most pertinent to the description of the present invention.

As defined in HANDBOOK OF ENGINEERING FUNDAMENTALS; Ovid W. Eshbach; Second Edition; Wiley Engineering Handbook Series; 1952:

"A polyhedron is a convex closed surface consisting of parts of four or more planes, called its faces; its faces intersect in straight lines, called its edges; its edges at points, called its vertices." [Emphasis added]

"A regular polyhedron has all faces formed of congruent regular polygons and all polyhedral angles equal." [Emphasis added]

Therefore, a regular octahedron is a convex closed surface consisting of eight faces that are congruent equilateral triangles that intersect each other at their edges which intersect each other at their vertices.

"A pyramid is a polyhedron of which one face, the base, is a polygon and the other, lateral faces, are triangles meeting in a common point called the vertex of the pyramid and intersecting one another in its lateral edges." [Emphasis added]

Therefore, an equilateral triangular pyramid is a polyhedron whose base is an equilateral triangle whose center coincides with the foot of the perpendicular dropped from the vertex to the base.

The configuration of the die for use with a croupier type gaming table 10 can best be seen in FIGS. 2–6, and as such will be discussed with reference thereto.

The die for use with a croupier type gaming table 10 comprises a core 14, and a skin 16 that is disposed on the core 14.

The core 14 has a shape that is a regular octahedron with eight faces 18 that are congruent equilateral triangles which intersect each other at their edges 20 which intersect each other at their vertices 22.

The skin 16 comprises eight equilateral triangular pyramids 24, each of which has a base 26 that is triangular, three lateral faces 28 that are triangular and meet in a common vertex 30 and intersect each other at three lateral edges 32.

The base 26 of each pyramid of the eight equilateral triangular pyramids 24 of the skin 16 is disposed on, and is congruent with, a respective face of the eight faces 18 of the core 14, with a respective pyramid of the eight equilateral triangular pyramids 24 of the skin 16 extending outwardly therefrom.

A lateral face of the three lateral faces 28 of a pyramid of the eight equilateral triangular pyramids 24 of the skin 16 and a lateral face of the three lateral faces 28 of an adjacent pyramid of the eight equilateral triangular pyramids 24 of the skin 16, which share a common edge of the edges 20 of a respective face of the eight faces 18 of the core 14, together define a set, with the skin 16 having a total of twelve sets thereon.

Two opposing sets of the twelve sets of the skin 16 are colored white, five opposing sets of the twelve sets of the skin 16 are colored red, and five opposing sets of the twelve sets of the skin 16 are colored black.

Each set of the twelve sets of the skin 16 is divided into four congruent triangles that are consecutively numbered, with each set of the twelve sets of the skin 16 alternating between different odd and even numbers, and with the numbers ranging from 1 to 48, i.e. twelve sets of the skin 16 multiplied by the four congruent triangles each equals 48, ergo 1–48.

Figure 6:
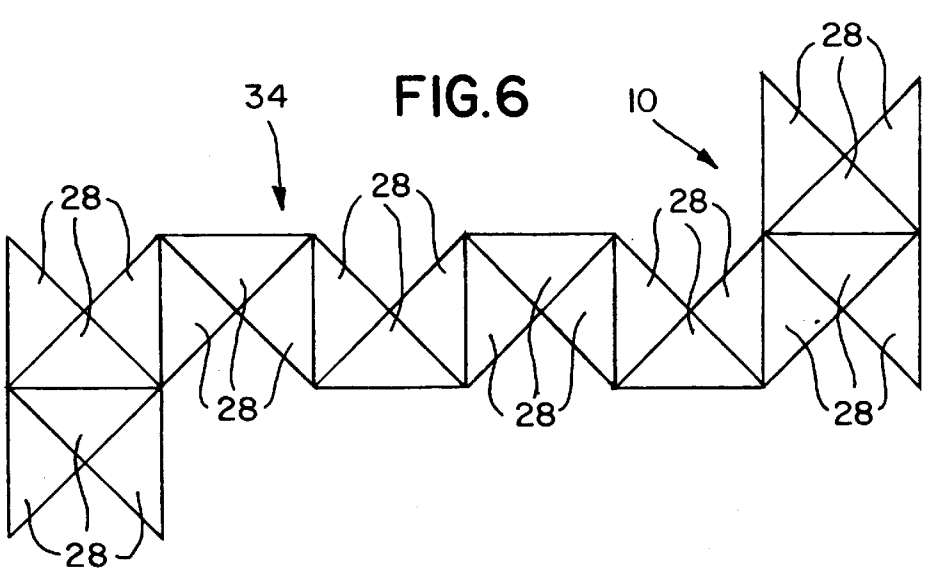
FIG. 6 is a top plan view of a flat pattern for constructing the present invention shown in FIGS. 2–5.
Figure 4:
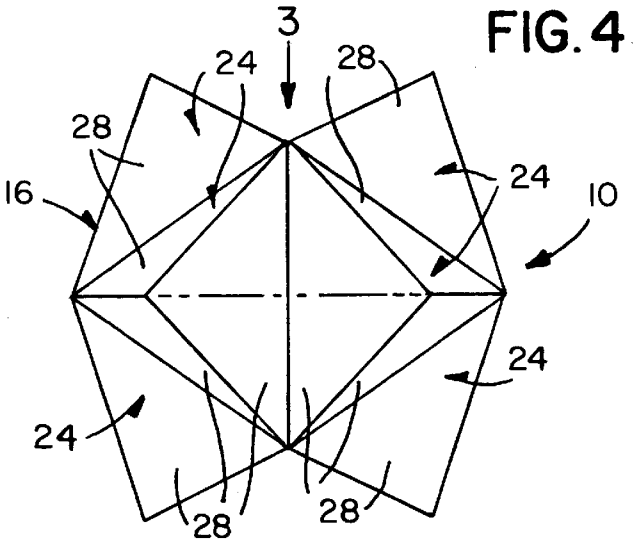
FIG. 4 is a diagrammatic side elevational view taken generally in the direction of arrow 4 in FIG. 2.
Figure 3:
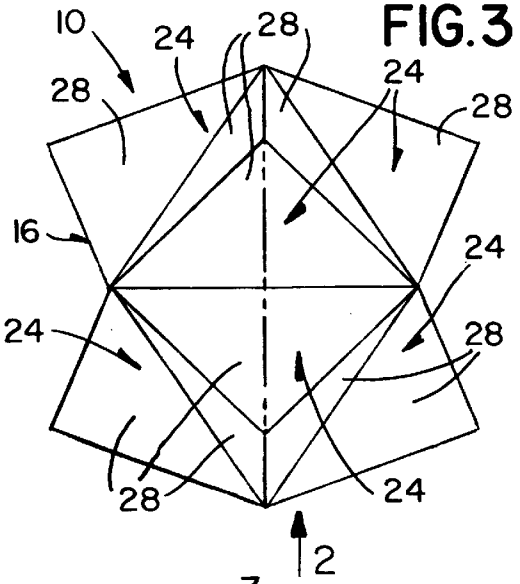
FIG. 3 is a diagrammatic top plan view taken generally in the direction of arrow 3 in FIG. 2.
Figure 2:
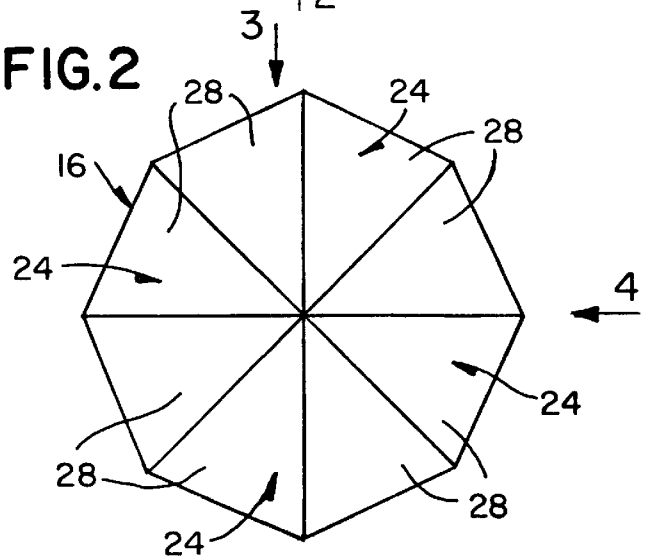
FIG. 2 is a diagrammatic front elevational view of the present invention.
Figure 5:
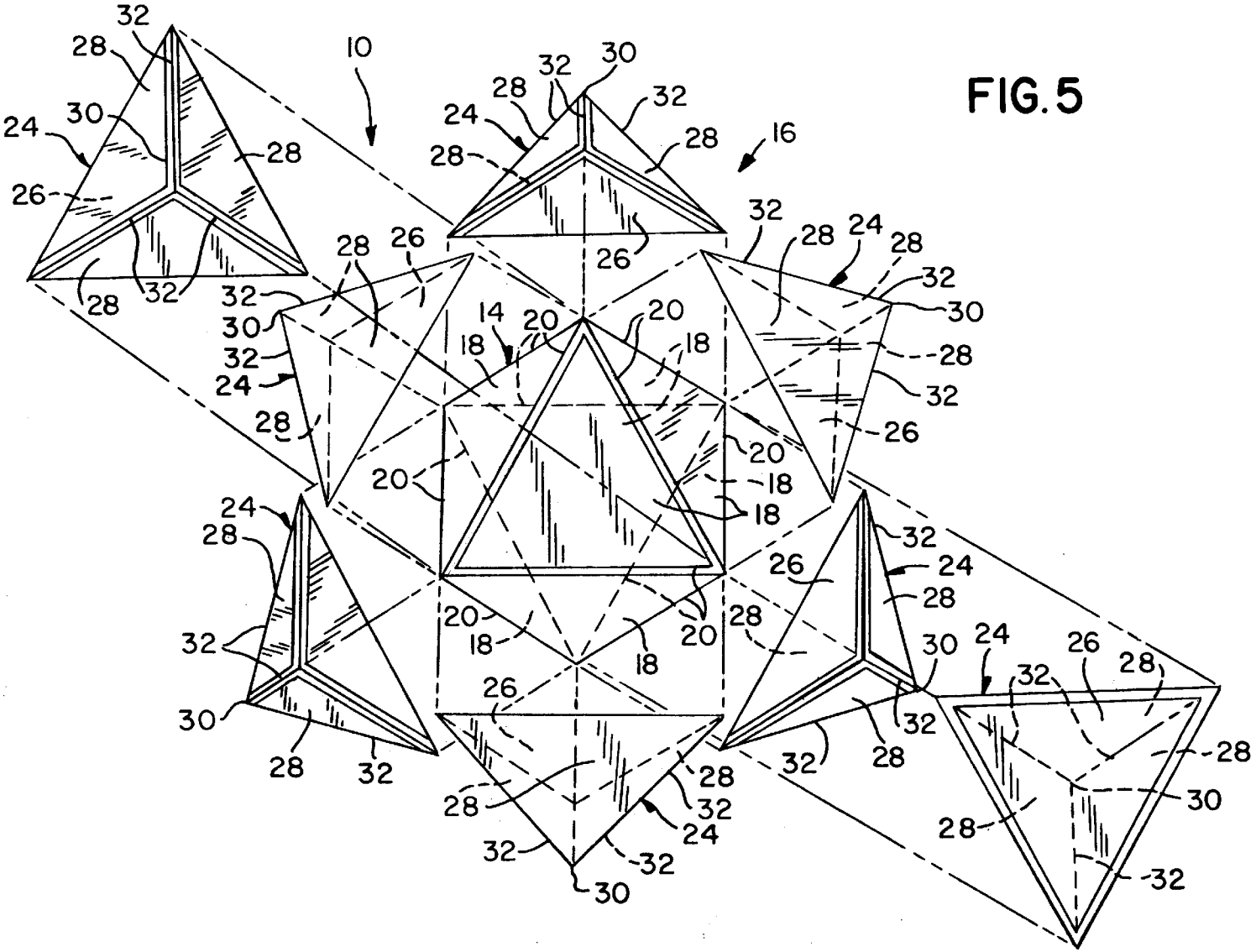
FIG. 5 is an enlarged exploded diagrammatic perspective view of the present invention shown in FIGS. 2–4.

As shown in FIG. 6, the die for use with a croupier type gaming table 10 can be constructed by folding a pattern 36.

It will be understood that each of the elements described above, or two or more together, may also find a useful application in other types of constructions differing from the types described above.

While the invention has been illustrated and described as embodied in a die for use with a croupier type gaming table, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A die for use with a croupier type gaming table for which there are many games which are devised and played appropriately with said die, said die comprising:

a) a core; and b) a skin disposed on said core, wherein said core has a shape that is a regular octahedron with eight faces that are congruent equilateral triangles which intersect each other at their edges which intersect each other at their vertices, wherein said skin comprises eight equilateral triangular pyramids, each of which has a base that is triangular, three lateral faces that are triangular and meet in a common vertex and intersect each other at three lateral edges.

2. The die as defined in claim 1, wherein said base of each pyramid of said eight equilateral triangular pyramids of said skin is disposed on, and is congruent with, a respective face of said eight faces of said core, with a respective pyramid of said eight equilateral triangular pyramids of said skin extending outwardly therefrom.

3. The die as defined in claim 1, wherein a lateral face of said three lateral faces of a pyramid of said eight equilateral triangular pyramids of said skin and a lateral face of said three lateral faces of an adjacent pyramid of said eight equilateral triangular pyramids of said skin, which share a common edge of said edges of a respective face of said eight faces of said core, together define a set, with said skin having a total of twelve sets thereon.

4. The die as defined in claim 3, wherein two opposing sets of said twelve sets of said skin are colored white, five opposing sets of said twelve sets of said skin are colored red, and five opposing sets of said twelve sets of said skin are colored black.

5. The die as defined in claim 3, wherein each set of said twelve sets of said skin is divided into four congruent triangles that are consecutively numbered, with each set of said twelve sets of said skin alternating between different odd and even numbers, and with said numbers ranging from 1 to 48.

* * * * *